US009342050B2

(12) United States Patent
Hessler et al.

(10) Patent No.: US 9,342,050 B2
(45) Date of Patent: May 17, 2016

(54) ILLUMINATED TIMEPIECE DISPLAY DEVICE

(71) Applicant: THE SWATCH GROUP RESEARCH AND DEVELOPMENT LTD, Marin (CH)

(72) Inventors: Thierry Hessler, St-Aubin (CH); Jean-Claude Martin, Montmollin (CH); Michel Willemin, Preles (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 14/433,284

(22) PCT Filed: Sep. 20, 2013

(86) PCT No.: PCT/EP2013/069568

§ 371 (c)(1),
(2) Date: Apr. 2, 2015

(87) PCT Pub. No.: WO2014/053338

PCT Pub. Date: Apr. 10, 2014

(65) Prior Publication Data

US 2015/0261188 A1 Sep. 17, 2015

(30) Foreign Application Priority Data

Oct. 4, 2012 (CH) ..... 01857/12

(51) Int. Cl.
*G04B 19/30* (2006.01)
*G04B 1/14* (2006.01)
(Continued)

(52) U.S. Cl.
CPC ..... *G04B 19/30* (2013.01); *G04B 1/145* (2013.01); *G04B 19/32* (2013.01); *G04B 17/066* (2013.01)

(58) Field of Classification Search
CPC ..... G04B 1/10; G04B 1/14; G04B 17/06; G04B 17/063; G04B 17/066; G04B 19/30; G04B 19/32; G04B 21/02; G04B 45/00; G04B 45/0007; G04B 1/145
See application file for complete search history.

(56) References Cited

U.S. PATENT DOCUMENTS 5,669,692 A * 9/1997 Thorgersen ..... G04B 19/30 362/23.15

(Continued)

FOREIGN PATENT DOCUMENTS

DE 837 070 6/1952
DE 10 2008 029 429 A1 4/2009

(Continued)

OTHER PUBLICATIONS

Electronic English translation of Rhul, FR2957688, originally published Sep. 23, 2011, translated Feb. 9, 2015.*

(Continued)

*Primary Examiner* — Amy Cohen Johnson
*Assistant Examiner* — Matthew Powell
(74) *Attorney, Agent, or Firm* — Oblon, McClelland, Maier & Neustadt, L.L.P.

(57) ABSTRACT

A watch includes a mechanical timepiece movement that includes at least one timepiece display device including a mobile timepiece component. The component transmits and diffuses light emitted by at least one light energy source included in the display device. The component is formed of a first material which is silica, or quartz, or single crystal quartz, or glass, or sapphire, or ceramic or material partially transparent to visible or ultraviolet wavelengths, or a transparent or translucent at least partially amorphous material, and of at least a second phosphorescent or fluorescent material applied in a thin layer to at least one of surfaces of the component. The light source, which is active or passive, injects light into one portion of the component which conveys and diffuses the light over at least one portion of the component, or throughout an entirety of the component, to make the component visible in the dark.

25 Claims, 1 Drawing Sheet

(51) Int. Cl.
*G04B 19/32* (2006.01)
*G04B 17/06* (2006.01)

(56) References Cited

U.S. PATENT DOCUMENTS 7,077,562 B2 * 7/2006 Bourgeois ..... F16F 1/021 267/166
7,293,913 B2 * 11/2007 Peters ..... G04B 18/026 368/175
2002/0001185 A1 * 1/2002 Wilhelm ..... G01D 13/28 362/23.2
2003/0103418 A1 * 6/2003 Hirano ..... G04G 9/0041 368/82
2004/0212988 A1 * 10/2004 Fuwausa ..... G01D 11/28 362/103
2012/0120776 A1 * 5/2012 Fleury ..... G04B 19/12 368/205
2013/0083508 A1 * 4/2013 Murata ..... G04B 19/30 362/23.16
2013/0094175 A1 * 4/2013 Shimane ..... G01D 7/08 362/23.19
2013/0250551 A1 * 9/2013 Schneider ..... G04B 19/30 362/97.1

FOREIGN PATENT DOCUMENTS

EP 1 319 998 A1 6/2003
FR 2957688 9/2011
WO 9524002 9/1995
WO 2014/001659 A2 1/2014

OTHER PUBLICATIONS

International Search Report Issued Feb. 6, 2014 in PCT/EP13/069568 Filed Sep. 20, 2013.

* cited by examiner

ILLUMINATED TIMEPIECE DISPLAY DEVICE

FIELD OF THE INVENTION

The invention concerns a timepiece display device including at least one mobile timepiece component for a watch or timepiece.

The invention also concerns a mechanical timepiece movement including at least one such timepiece display device.

The invention also concerns a timepiece including one such mechanical movement and/or at least one such timepiece display device.

The invention concerns the field of mechanical horology.

BACKGROUND OF THE INVENTION

The display of the various timepiece functions is often complex in mechanical timepieces which include complications. The spatial distribution of the outputs of these complication mechanisms often makes direct display by hands or discs inconvenient, and requires the use of intermediate wheels, which further complicate the timepiece, make it more expensive and increase its thickness.

Other functions require providing the user with rapid and approximate information, this is especially true of power reserve displays, which indicate to the user when recharging is desirable.

Every display consumes energy, and cumulative energy consumption is a chronic problem of mechanical watchmaking.

SUMMARY OF THE INVENTION

The invention proposes to provide a compact, low energy consumption solution to the problem of the visual presentation of certain timepiece displays in a mechanical watch, or, more generally, in a mechanical timepiece.

To this end, the invention concerns a timepiece display device including at least one mobile timepiece component for a watch or timepiece, characterized in that said at least one timepiece component transmits and diffuses the light emitted by at least one light energy source.

According to a feature of the invention, said at least one timepiece component is made of silica, or quartz, or single crystal quartz, or glass, or sapphire, or ceramic or material partially transparent to visible or ultraviolet wavelengths or transparent or translucent at least partially amorphous material.

The invention further concerns a mechanical timepiece movement including at least one such timepiece display device, characterized in that said light source is either located in said timepiece display device, or is moved out of said timepiece display device and inside said movement, in which case it is connected by at least one light guide or one optical fibre to a light relay which is located in said timepiece display device in proximity to said timepiece component.

The invention further concerns a timepiece including one such mechanical movement and/or at least one such timepiece display device, characterized in that said light source is either located in said timepiece display device, or is moved out of said timepiece display device and inside said movement, in which case it is connected by at least one light guide or one optical fibre to a light relay which is located in said timepiece display device in proximity to said timepiece component or to the contact thereof, or is moved out of said movement and inside said timepiece, in which case it is connected by at least one light guide or one optical fibre to a light relay which is located in said timepiece display device in proximity to said timepiece component or to the contact thereof.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 7A:
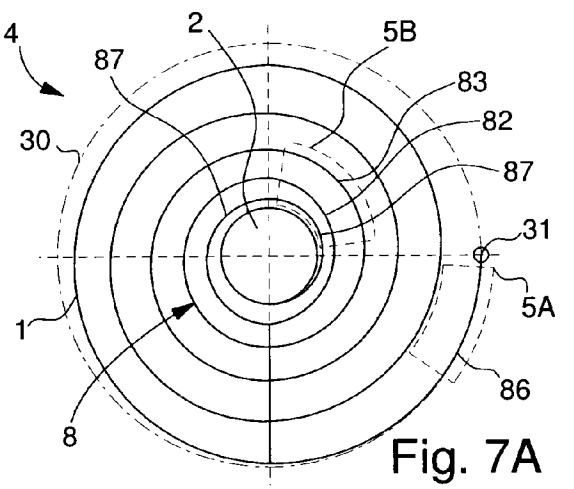
FIG. 7 shows a partial plan view of two light sources disposed underneath a mainspring, one in proximity to the barrel arbor, and the other in proximity to a slip-spring for hooking the spring to a drum, in two positions of the spring, at maximum contraction in FIG. 7A and at maximum elongation in FIG. 7B.

The invention concerns the field of mechanical horology.

The invention provides a new visual presentation of a timepiece display device in a mechanical watch, or, more generally, in a mechanical timepiece.

More specifically, it renders the timepiece display device luminous, by using, to make at least one of its constituent parts called the "timepiece component", a particular material permitting light diffusion, and allowing visual presentation of information about the state of said component, either by revealing mechanical stresses in its internal structure, or by revealing its particular relative position in relation to its environment, for example the activating or desativating of a particular function. In particular and in a non-limiting manner, silicon, quartz, single crystal quartz, sapphire and glass may be used as light guides.

Light from an active or passive light source, injected into one portion of the timepiece component, exits in a distributed manner over at least one portion of the timepiece component, or over the entire length of the timepiece component, which enables it to be seen in the dark. The timepiece component conveys and diffuses this light. Injection of light may be performed more easily at one of the ends of the timepiece component, and in particular at an outer end preferably remote from the centre of the timepiece movement, by a light source such as a light emitting diode, or a component coated with a passive phosphorescent layer; such light sources are non-limiting.

If necessary, the timepiece component is coated with a layer permitting outward diffusion of only one part of the light, while guiding most of the light along the timepiece component, this surface layer may also be phosphorescent or fluorescent. The silica, quartz, single crystal quartz, glass, sapphire, photo-structurable glass, or similar material of the timepiece component, may be developed to include phosphorescence or fluorescence, either in the mass of the material, or by means of implantation. The timepiece component according to the invention behaves like an optical fibre, for guiding and/or diffusing light.

It is understood that, not just the presence or absence of light, but also any modulation of this light, and/or a change in its wavelength, provide information to the user.

Thus the invention concerns such a timepiece display device 4 including at least one mobile timepiece component 1 for a watch or timepiece movement 100.

Although the invention is described here in the advantageous case of a mechanical movement 10, the invention is, of course, equally applicable to the mechanisms of an electronic or hybrid mechanical-electronic movement.

According to the invention, this mobile timepiece component 1 transmits and diffuses the light emitted by at least one light energy source 5 comprised in said timepiece display device 4, or the movement, or the watch, or the timepiece 100.

"Mobile" means here a timepiece component which either changes position or location due to its function, such as a wheel and pinion pivoting between two pivots, or a lever, or other element, or which is deformed due to its function during the operation of timepiece movement 10, such as a mainspring or a regulating balance spring; these examples are non-limiting.

The present description is illustrated for a particular non-limiting case, which is that of a mainspring, for the visual presentation of its power reserve. Those skilled in the art will know how to adapt this example to other components and other functions of a watch. The invention applies particularly well to slender and elastic components, since their function is precisely related to their elastic nature and to their change of state over time, related to a change in state of internal and external stresses.

The mobile watch or timepiece component 1 is represented here by a mainspring 1, mounted between an arbor 2 and a structure 3, which may be a drum, or a bridge or similar element here.

The invention is described here, in a non-limiting manner, in the case of substantially flat timepiece component, i.e. which, in every end and intermediate position of timepiece component 1, extends entirely between two parallel planes P1 and P2. In the specific case of a spring, only an inner coil at inner end 7 of timepiece component 1, and an outer coil, at outer end 6 of timepiece component 1, may, in a known manner, extend in space outside the gap between these two planes, for attachment of the spring to other elements, here an arbor 2 and a drum 3.

According to the invention, the at least one timepiece component transmits and diffuses light emitted by at least one light energy source 5.

In a preferred embodiment, this at least one timepiece component is made of silica, or quartz, or single crystal quartz, or glass, or ceramic, such as sapphire, or of material partially transparent to visible or ultraviolet wavelengths, or of transparent or translucent at least partially amorphous material.

This light energy source 5 may be a primary source, which stores energy, then returns it through light transmission, or a secondary source, which is called here a "light relay" 50, connected by an optical path formed by a light guide 51 or an optical fibre or similar, to such a primary source 5. Timepiece component 1 is then either in contact, or in immediate proximity, either to a primary source, or to a light relay 50, the choice being made according to the space available in the watch and the volume of source 5 or of relay 50.

Figure 1:
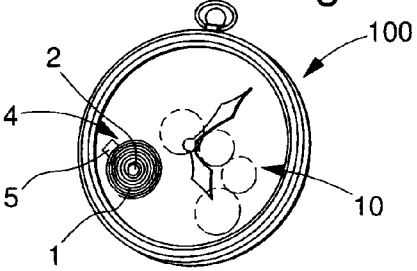
FIG. 1 is a schematic view of a timepiece, in this case a watch, with a movement including a timepiece display device according to the invention, comprising at least one mobile timepiece component, in an application specific to the display of the power reserve of the timepiece component, which is a mainspring.
Figure 6:
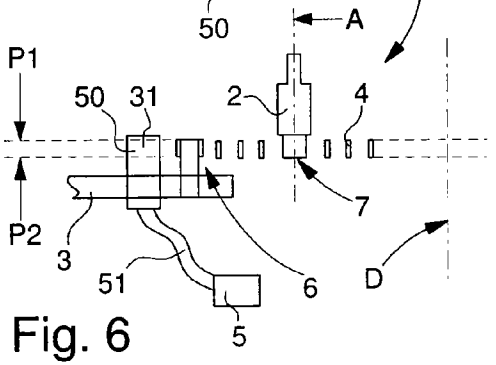
FIG. 6 shows a schematic, partial, cross-sectional view, through the pivot axis of the barrel arbor, of the timepiece display device of FIG. 1, wherein a light source located inside a watch, and which is not in immediate proximity to the display device, is connected by a light guide to a light relay positioned on a bridge in proximity to the timepiece display device or to the timepiece component.

In a particular embodiment illustrated by FIGS. 1 and 6, drum 3 carries the light energy source 5 in proximity to an outer end 6 of timepiece component 1. It is understood that drum 3 may equally carry a primary source 5 or a light relay 50, the choice again being made according to the space available in the watch and the volume of source 5 or of relay 50.

In another variant not illustrated by the Figures, arbor 2 carries light energy source 5, or a light relay 50 in proximity to an inner end 7 of timepiece component 1. This may, in particular, be the case with a one-piece assembly of an arbor-timepiece component made of silica, or quartz, or single crystal quartz or glass or ceramic, such as sapphire, or transparent or translucent at least partially amorphous material, and light can be collected and returned in a convergence area, for example at the arbor or suchlike.

Figure 7B:
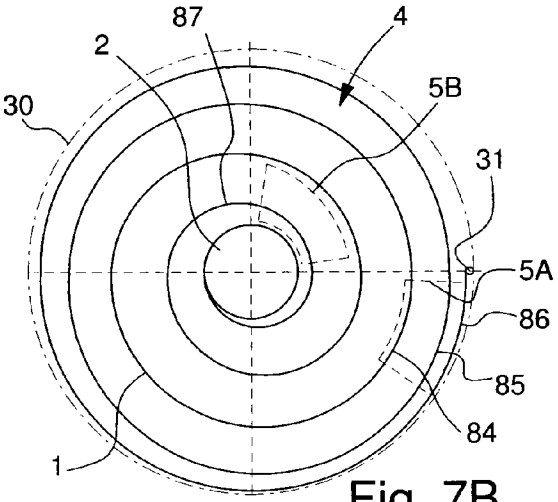

In yet another variant, for this specific example of component 1 formed of a spiral wound spring, light source 5 or relay 50 is in proximity to timepiece component 1, above or below the coils of the timepiece component. In a particular version of this variant, several such sources are disposed in proximity to timepiece component 1. FIG. 7 therefore shows two light sources 5A and 5B, disposed underneath timepiece component 1, one in proximity to the member for attachment of the timepiece component to arbor 2 and the other in proximity to the system for attaching timepiece component 1 to drum 3. In the case of a regulating balance spring, the attaching member is a collet 21 and the system of attachment is a balance spring stud 31. In the case of a mainspring, the member for attachment to the arbor is a hook of arbor 2 cooperating with a hole in the eye, and the system of attachment is a slip-spring or similar. Their arrangement is such that the first source 5A comes into immediate proximity to at least one outer coil 86, and preferably to several consecutive outer coils 84, 85, 86 during the maximum elongation of timepiece component 1 and transmits light at the same time to all three of these coils 84, 85, 86 only in this elongated configuration, whereas source 5A only transmits light to one of the coils 86 in the contracted configuration of the timepiece component. Similarly, a second source 5B comes into immediate proximity to at least one inner coil 87 and preferably to several consecutive inner coils 87, 82, 83, during the maximum contraction of timepiece component 1 and transmits light at the same time to all three of these coils 87, 81, 82 only in this contracted configuration, whereas source 5B only transmits light to one of the coils 87 in the elongated configuration of the timepiece component. It is therefore possible to visually present the contraction or elongation of timepiece component 1, either through the use of different coloured filters on first source 5A and second source 5B, or by colouring outer coil 86 (and neighbouring coils 84 and 85) of timepiece component 1 differently from inner coil 87 (and neighbouring coils 81 and 82), either in the mass of the material forming the timepiece component, or more simply by means of a surface layer 40 on at least one of the lateral surfaces, also called faces here, of timepiece component 1.

Due to the choice of particular materials for making timepiece component 1, when it is flat as in the present case, the component is preferably made in clusters on the same substrate. Each timepiece component 1 includes a relatively large attaching member with large dimensions in comparison with the cross-section S of coils 8 of timepiece component 1. This attaching member forms a receiving surface well suited for the light emanating from source 5 or from relay 50, and at the same time provides a good mechanical attachment of timepiece component 1 to drum 3.

The at least one timepiece component 1 diffuses light over at least one portion of its largest dimension called the length and/or over at least one portion of the section thereof orthogonal to said length.

Preferably, but in a non-limiting manner, this timepiece component 1 includes upper 41, lower 42, inner transverse 46, outer transverse 47 lateral faces. The light is thus diffused on at least one of the lateral faces of the timepiece component. The component further includes two outer 43 and inner 43A end faces, generally limited to its sections and corresponding to at least one area of attachment of component 1.

In the frequent case where one of the lateral faces is not visible to the user, since it faces a non-transparent component, main plate, or bridge of a movement, this non-visible surface may advantageously include a thin surface metallization layer 40 to form a reflective mirror surface and to prevent light diffusion through the non-visible surface concerned. This may be the case, in particular, of lower face 42 and/or transverse faces 46, 47. Local coating of all of the lateral surfaces with such a reflective layer 40 enables light to be channeled into the timepiece component over a certain distance without any significant loss. It is therefore possible to choose, over the length of timepiece component 1, the areas through which light diffusion is desired, and the orientation of the faces concerned, generally speaking upper face 41 and one and/or the other of transverse faces 46, 47.

In a particular embodiment, the at least one timepiece component 1 diffuses light over its entire length between drum 3 and arbor 2.

Figure 2:
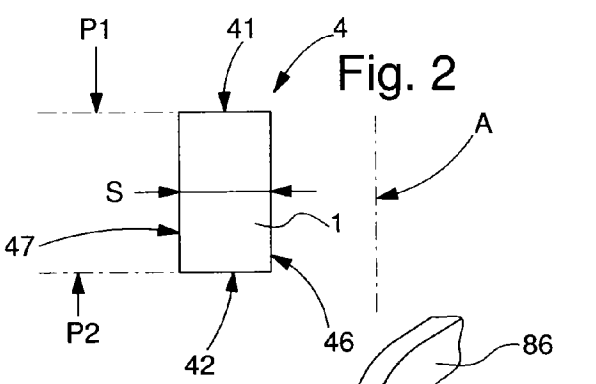
FIG. 2 shows a schematic view of a common cross-section of a timepiece component according to a first embodiment wherein the timepiece component is of rectangular cross-section, and is bare.

Preferably, the at least one timepiece component 1 is of rectangular cross-section and is formed of a single material, for example silica, or quartz, or single crystal quartz, or glass, or sapphire, or ceramic or a material partially transparent to visible or ultraviolet wavelengths or a transparent or translucent at least partially amorphous material, according to FIG. 2.

In a variant of the invention, the at least one timepiece component 1 is of rectangular cross-section and is formed of at least two materials: on the one hand, a first material which is silica, or quartz or single crystal quartz, or glass, or sapphire, or ceramic, or a material partially transparent to visible or ultraviolet wavelengths or a transparent or translucent at least partially amorphous material, and on the other hand, a phosphorescent or fluorescent dopant, said dopant being incorporated into the mass of the first material. The material, quartz or glass or suchlike can be doped in the mass, for example by implantation, with at least one such phosphorescent or fluorescent dopant.

In another variant, the at least one timepiece component 1 is of rectangular cross-section and is formed, on the one hand, of a first material which is silica, or quartz, or single crystal quartz, or glass, or sapphire, or ceramic, or a material partially transparent to visible or ultraviolet wavelengths or a transparent or translucent at least partially amorphous material, and on the other hand, of at least a second phosphorescent or fluorescent material applied in a thin layer 40 to at least one of the lateral surfaces of timepiece component 1.

Figure 3:
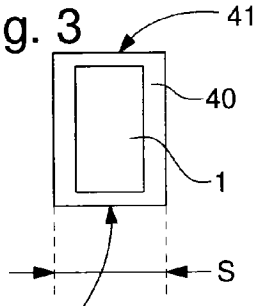
FIG. 3 shows a schematic view of a common cross-section of a timepiece component according to a second embodiment wherein the timepiece component is of rectangular cross-section, and includes a thin coating on its four long faces.

In the variant visible in FIG. 3, the second phosphorescent or fluorescent material is applied in a thin layer 40 to the four lateral surfaces of timepiece component 1.

In an advantageous variant, the at least one timepiece component 1 includes, on its upper 41 and lower 42 faces defining two parallel planes P1, P2, a surface roughness Rt of between 10 nanometers and 20 micrometers, and preferably close to one micrometer or slightly greater than this value. This slight roughness giving timepiece component 4 a frosted appearance may be obtained during manufacture of a quartz timepiece component 1, for example, wherein the control parameters of the method allow a more or less smooth surface finish to be obtained. The presence, at certain angles, of an overhang along transverse faces 46, 47 may provide a similar effect. Timepiece component 1 may also be reworked, particularly by chemical etch, in order to include micro-cells providing the required local roughness.

The addition of thin layer depositions 40 according to FIG. 3, for example, can increase or attenuate the diffusion or guiding of light inside timepiece component 1. The case of a fluorescent or phosphorescent layer 40 can either modify the transmission spectrum (for example if a UV light emitting diode is used as light source 5), or enable light to be stored and transmitted within the layer. There is known, in particular, strontium aluminate SrAl2O4 doped with europium, one variety of which is known by the name "Super-Luminova".

Such a thin layer deposition 40 can be used to colour at least one lateral face when light is retransmitted by diffusion through at least one coil of timepiece component 1.

Layer deposition can also ensure the surface roughness required for good diffusion.

The thickness of this layer 40 is preferably comprised between 10 nanometers and 1 micrometer, and preferably close to 100 nanometers.

It is possible to use layers 40 of various natures: metals, oxides, for example TiO, $TiO_2$, $Ta_2O_5$, $SiO_2$, $Si_3N_4$, $Al_2O_3$, or aluminium and gold based intermetallics, although this list is non-limiting. It is also possible to coat the various lateral faces with layers 40 of different natures.

A layer 40 may be coloured in a particular wavelength. Interaction with light derived from source 5 produces a particular effect, especially if source 5 or relay 50 includes a monochromatic filter, or is pulsed on a single wavelength.

It is possible to structure the lateral faces of timepiece component 1, particularly in photolithography.

The path of the light inside timepiece component 1 can be modified by the presence of particular obstacles or changing light environments, for example by the presence of notches, pierced holes, chamfers or suchlike.

Structuring in masks, during the manufacture of timepiece component 1, makes it possible to create specific transverse surfaces 46, 47 for two neighbouring coils of timepiece component 1, particularly when, like here, it is a spring, particularly by the pairing of notches or of optical polarity for example, so that an inner transverse surface 46 of the outermost of the two coils cooperates in a specific manner when closest to the outer transverse surface 47 of the innermost of the two coils during the contraction of timepiece component 1, and so that the optical effect produced during this greatest proximity is different from the optical effect that the two neighbouring coils exhibit together when they are at the greatest distance from each other during the elongation of timepiece component 1. In particular, these two opposing transverse surfaces may receive a different monochrome treatment, for example blue on one surface, yellow on the other, these two colours being distinctly visible during elongation, whereas diffusion occurs in green in the contracted position.

Figure 4:
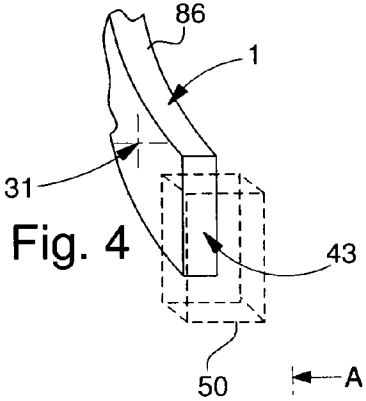
FIG. 4 is a schematic, partial and perspective view of the end of a timepiece component in the form of a mainspring with an outer coil whose cross-section is parallel to the other coils, this end facing a light relay.

In a particular embodiment, at least one of ends 6, 7 of timepiece component 1 includes an end face 43 directly receiving light from light source 5 or from a light relay 50 of said source. FIG. 4 illustrates such an embodiment, where all the coils of timepiece component 1 are parallel.

Figure 5:
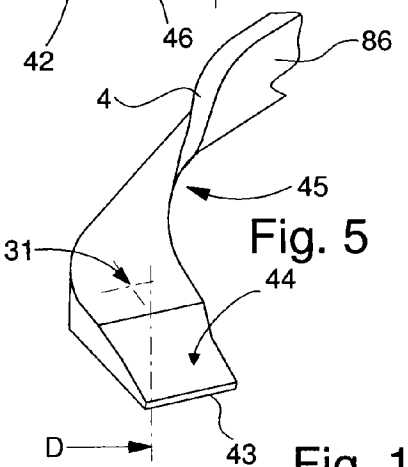
FIG. 5 shows a schematic, partial and perspective view of the end of a timepiece component in the form of a mainspring with a twisted outer coil whose cross-section is perpendicular to the other coils, this end comprising a bevel for collecting light arriving substantially perpendicular to the plane of the bevel.

In another particular embodiment visible in FIG. 5, and particularly in the case where timepiece component 1 includes a twist 45 close to one of its ends 6 7, this end includes at least one bevel 44 for receiving light in a direction D substantially perpendicular to a plane parallel to two parallel planes P1, P2, defined by the upper 41 and lower 42 faces of timepiece component 1. Direction D is advantageously parallel to the pivot axis A of arbor 2. This arrangement makes it possible to arrange a light source 5 or light relay 50 above or below timepiece component 1, just above or below drum 3, which may be advantageous in terms of space.

The invention makes it possible to make timepiece component 1 as a light guide with controlled losses along the entire length of the timepiece component.

The illumination of timepiece component 1 does not necessarily occur in a preferred direction, indeed, it may occur through an upper face 41 (plane P1 in the Figures), and/or through transverse faces 46, 47 of timepiece component 1.

Depending on the design of light source 5 and that of timepiece component 1, several types of illumination may be obtained. In particular, the following will be cited:

- constant illumination, despite the motion of the timepiece component;
- variable illumination, according to the motion of the timepiece component, for example to simulate the beating of a human heart: it is possible to illuminate the timepiece component throughout its length when the coils are close to each other, and to reduce the illumination to a minimum (extinction effect) when the coils are remote from each other; or vice versa. Losses are therefore controlled in accordance with the position of the coils;
- coloured illumination, with different colours at the two ends of the timepiece component, which can be obtained with a timepiece component 1 coated with ad hoc thin layers 40.

The coupling between light source 5, or relay 50, and timepiece component 1, may result from their proximity: source 5 or relay 50 transmits light with a sufficient level of energy for timepiece component 1 to capture the light, before retransmitting it through diffusion.

The coupling may also advantageously and preferably be achieved by direct surface-to-surface contact, or by a plug-in arrangement, or by any known light guide and optical fibre technology.

Preferably, the light is concentrated upstream of its transmission to the timepiece component, or when it enters timepiece component 1, in a concentrator. In a particular and advantageous embodiment, the concentrator is integrated in timepiece component 1 during manufacture.

The distribution of stresses in timepiece component 1 varies during the contraction or elongation of the timepiece component for a given setting. It also varies during a change in characteristics of the mobile timepiece component: In particular, in the case of a regulating balance spring, according to the amplitude of oscillation of arbor 2, a variation in the illumination of timepiece component 1 may, therefore, reveal a modification of amplitude.

Timepiece component 1 according to the invention may be inhomogeneous, which thus makes it possible to create particular technical functions, and distinct light diffusion areas.

To "make amorphous" means here changing structure so as to modify the refractive index. A coil can be made amorphous locally, particularly by means of a laser treatment.

Timepiece component 1 may be at least locally polished. Particular mechanical structuring makes it possible to create light leakage surfaces selected with specific orientations on certain surfaces and at specific locations.

The difficulties in guiding and diffusing light throughout the length of a timepiece component 1, which may have a large extended length, may result in neutralization of some coils, or some coil portions, preventing light from escaping therefrom, for example by means of reflective layers or similar functional masks This therefore makes it possible to save light and to guide light to the ends 6 and 7 of timepiece component 1.

In a particular preferred embodiment, mobile timepiece component 1 includes at least one elastic and deformable portion, and light diffusion through mobile timepiece component 1 varies with the stresses in this elastic and deformable portion.

In a particular embodiment, mobile timepiece component 1 is an energy storage spring or a mainspring or a striking spring, and the illumination mode thereof visually displays the remaining power reserve.

In another particular embodiment, mobile timepiece component 1 is a play take-up spring. Yet more specifically, it forms a play take-up spring for an altimeter.

In another particular embodiment, mobile timepiece component 1 is a split-time counter spring.

In yet another particular embodiment, mobile timepiece component 1 is a jumper or jumper spring.

Component 1 may also be a spiral spring made of the same material which has functions other than that of a regulating balance spring.

Component 1 may also be a quartz spiral spring arranged to be used as a return spring for removing play from a hand or similar.

Light source 5 may take various forms. Preferably, source 5 is a light emitting diode or a phosphorescent or fluorescent component.

Advantageously, source 5 is phosphorescent and/or fluorescent, preferably phosphorescent because of the longer afterglow duration, which may be up to several hours, and is compatible with the possibility of illuminating the timepiece component at any time throughout the duration of one night.

The light source will be termed "phosphorescent" in the description below for the sake of simplicity. Such a phosphorescent source advantageously comprises rare earth aluminates, well known to physicists, for example strontium aluminate $SrAl_2O_4$ doped with europium, one variety of which is known as "Super-LumiNova", or rare earth silicates, or a mixture of rare earth aluminates and silicates. Other commercial materials such as "Lumibrite" are also suitable. Materials like tritium (3H), promethium-147, or radium-226 have excellent phosphorescent properties, but their high beta and/or gamma radioactivity greatly limits their use, and they can only be used in trace amounts, preferably in combination with rare earth aluminates, for some very specific military or astronautic applications, use at great depths, or similar, and with protection which considerably increases the volume of the timepiece; the terms "radioluminescence" or "autoluminescence" are employed where these materials are used. There are also known borosilicate glass capsules containing gases, known as "GTLS" (gaseous tritium light sources) produced by MB Microtech, containing tritium (3H), and which, like radium, do not require any external excitation to emit light, such capsules are used in particular for illuminating mainly military watch hands or appliques.

The excitation light originates from the user's environment, solar light, ambient light. The light source is housed inside the inner volume of the case of the timepiece or of the watch. The ambient energy can be collected in a partially or totally transparent, or translucent case middle and/or in a partially or totally transparent or translucent dial and/or in a display aperture, particularly for a date or suchlike. Ambient energy may also be collected by an accessory adjoining the timepiece, such as a watch bracelet or strap, and be transmitted by a wave guide or fibre optic or suchlike. Similarly, ambient energy may be captured in other external parts such as the back cover, bezel, flange or other parts.

Light source 5 may emit monochromatic pulsed light.

One of the preferred applications of the invention is the visual presentation of internal stresses within the timepiece component, revealed by the light emanating from light source 5 transmitted and diffused by component 1.

The invention also concerns a timepiece movement 10 including at least one such timepiece display device 4. Light source 5 is either located in timepiece display device 4 or is moved out of timepiece display device 4 and inside movement 10, in which case it is connected by at least one light guide 51 or one optical fibre to a light relay 50 which is located in timepiece display device 4 in immediate proximity to mobile timepiece component 1 or to the contact thereof.

The invention also concerns a timepiece 100 including one such mechanical movement 10 and/or at least one such timepiece display device 4. Light source 5 is either situated in timepiece display device 4, or is moved out of timepiece display device 4 and inside movement 10, in which case it is connected by at least one light guide 51 or one optical fibre to a light relay 50 which is situated in timepiece display device 4 in immediate proximity to timepiece component 1, or is moved out of movement 10 and inside timepiece 100, in which case it is connected by at least one light guide 51 or one optical fibre to a light relay 50 which is situated in timepiece display device 4 in immediate proximity to mobile timepiece component 1 or to the contact thereof.

Preferably, this timepiece 100 is a watch, and timepiece component 1 is of the "flat" type described above.

In a variant not illustrated in the Figures, if component 1 is mobile with a high oscillation frequency, the invention may be coupled to a stroboscopic device inserted on the light trajectory between the light source and the timepiece component, so as to achieve particular lighting effects.

Stroboscopic structuring, according to the frequency and wavelength of the light diffused by source 5 or relay 50, makes it possible to produce an anti-counterfeiting mark or a secret signature, by structuring or masking, and which is only revealed under certain lighting conditions.

The slowing of light, due to a refractive index variation which is linked to a variation in internal stresses during the contraction or elongation of the timepiece component, also makes specific authentication possible.

Diffusion by a timepiece component 1, treated and coloured in a first wavelength, of a monochromatic pulsed light in another wavelength, provides a particular visual display.

A variant of the invention, more applicable to clocks and static timepieces, consists of application to a mobile timepiece component, which is not a substantially flat balance spring as above, but which is a helical spring.

In short, the device for visual presentation of a timepiece component offered by the invention is compact, and low energy consuming. It draws the user's gaze to the visible heart of his or her watch or timepiece, and highlights the particularly living nature of a mechanical timepiece, while requiring fewer mechanical elements for displaying the state of a timepiece function.

The invention claimed is:

1. A watch comprising:

a mechanical timepiece movement which includes at least one timepiece display device, the display device including at least one mobile component deforming due to a function thereof during operation of the movement, the mobile component being a slender, elastic component whose function is related to its elastic nature, wherein the mobile component transmits and diffuses light emitted by at least one light energy source comprised in the timepiece display device, and wherein the mobile component includes at least one elastic and deformable portion, and diffusion of light through the mobile component varies with stresses in the elastic and deformable portion, wherein the mobile timepiece component is formed of a first material which is silica, or quartz, or single crystal quartz, or glass, or sapphire, or ceramic, or a material partially transparent to visible or ultraviolet wavelengths, or a transparent or translucent at least partially amorphous material, and of at least a second phosphorescent or fluorescent material applied in a thin layer to at least one of surfaces of the mobile component, and wherein the light energy source, which is active or passive, is configured to inject light into one portion of the mobile component which conveys and diffuses the light over at least one portion of the mobile component, or throughout an entirety of the mobile component, to make the mobile component visible in the dark.

2. The watch according to claim 1, wherein the mobile component is formed of a spiral wound spring, the light energy source is in proximity to the spring, above or below coils of the spring.

3. The watch according to claim 2, wherein two of the light energy sources are disposed underneath the spring, one in proximity to a member that attaches the spring to an arbor, and the other in proximity to a system of securing the spring to a drum or to a stud.

4. The watch according to claim 3, wherein the mobile component is a regulating balance spring, the member that attaches the spring to an arbor is a collet, and the securing system is a balance spring stud.

5. The watch according to claim 3, wherein the mobile component is a mainspring, the member that attaches to the arbor is a hook of an arbor cooperating with a hole in an eye of the spring, and the securing system is a slip-spring or similar.

6. The watch according to claim 3, wherein the arrangement of the light energy sources is such that a first light energy source comes into immediate proximity to plural consecutive outer coils, during a maximum elongation of the spring and transmits light at a same time to all three of the outer coils only in the elongated configuration, whereas the first light energy source only transmits light to one of the outer coils in a contracted configuration of the spring, and such that, a second light energy source comes into immediate proximity to plural consecutive inner coils during a maximum contraction of the spring and transmits light at a same time to all three of the inner coils only in the contracted configuration, whereas the second light energy source only transmits light to one of inner coils in the elongated configuration of the spring.

7. The watch according to claim 6, wherein contraction or elongation of the spring is visually displayed, either through use of different colored filters on the first light energy source and the second light energy source, or by coloring the outer coils of the spring differently from the inner coils in a mass of the material forming the spring or in a surface layer on at least one of lateral surfaces of the spring.

8. The watch according to claim 2, wherein the light energy source is at one of ends of the mobile component remote from a center of the movement.

9. The watch according to claim 1, wherein the light energy source is at one of ends of the mobile component.

10. The watch according to claim 1, wherein the light energy source is a light emitting diode.

11. The watch according to claim 1, wherein the light energy source is a component coated with a passive phosphorescent layer.

12. The watch according to claim 1, wherein the mobile component diffuses light over at least one portion of a largest dimension thereof as a length and/or over at least one portion of a section thereof orthogonal to the length.

13. The watch according to claim 1, wherein the mobile component diffuses light over an entire largest dimension as a length.

14. The watch according to claim 1, wherein the mobile component is of rectangular cross-section and includes at least one phosphorescent or fluorescent dopant, incorporated in a mass of the first material.

15. The watch according to claim 1, wherein the mobile component is of rectangular cross-section.

16. The watch according to claim 1, wherein the second phosphorescent or fluorescent material is applied in the thin layer to four lateral surfaces of the mobile component.

17. The watch according to claim 1, wherein the mobile component is of rectangular cross-section and includes at least one colored material applied in a thin layer to at least one of the surfaces of the mobile component.

18. The watch according to claim 1, wherein the mobile component includes, on upper and lower faces thereof defining two parallel planes, a surface roughness between 10 nanometers and 20 micrometers.

19. The watch according to claim 1, wherein at least one of ends of the mobile component includes an end face directly receiving light from the light energy source.

20. The watch according to claim 19, wherein the at least one of the ends includes at least one bevel to receive light in a direction substantially perpendicular to a plane parallel to two parallel planes defined by upper and lower faces of the mobile component.

21. The watch according to claim 1, wherein the mobile component is an energy storage spring or a mainspring or a striking spring, and a mode of illumination thereof visually displays a remaining power reserve.

22. The watch according to claim 1, wherein the mobile component is a play take-up spring.

23. The watch according to claim 22, wherein the mobile component is a play take-up spring for an altimeter watch.

24. The watch according to claim 1, wherein the mobile component is a split-time counter spring.

25. The watch according to claim 1, wherein the mobile component is a jumper or jumper spring.

* * * * *